US011846010B2

(12) United States Patent
Mann et al.

(10) Patent No.: US 11,846,010 B2
(45) Date of Patent: Dec. 19, 2023

(54) ALUMINUM ALLOY WITH ADDITIONS OF COPPER, LITHIUM AND AT LEAST ONE ALKALI OR RARE EARTH METAL, AND METHOD OF MANUFACTURING THE SAME

(71) Applicant: The Boeing Company, Chicago, IL (US)

(72) Inventors: Austin E. Mann, St. Louis, MO (US); Andrew H. Baker, St. Louis, MO (US); Rajiv Mishra, Denton, TX (US); Sivanesh Palanivel, San Jose, CA (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 17/326,492

(22) Filed: May 21, 2021

(65) Prior Publication Data

US 2021/0277508 A1 Sep. 9, 2021

Related U.S. Application Data

(62) Division of application No. 15/484,288, filed on Apr. 11, 2017, now abandoned.

(51) Int. Cl.
*C22F 1/057* (2006.01)
*C22C 21/18* (2006.01)
(Continued)

(52) U.S. Cl.
CPC ..... *C22F 1/057* (2013.01); *B22D 7/005* (2013.01); *C22C 21/12* (2013.01); *C22C 21/14* (2013.01); *C22C 21/16* (2013.01); *C22C 21/18* (2013.01)

(58) Field of Classification Search
CPC ..... B22D 7/005; C22C 21/12; C22C 21/14; C22C 21/16; C22C 21/18; C22F 1/057; B23K 20/12
See application file for complete search history.

(56) References Cited

U.S. PATENT DOCUMENTS 4,832,910 A * 5/1989 Rioja ..... C22C 21/00 420/533
5,211,910 A * 5/1993 Pickens ..... C22C 21/12 420/539

(Continued)

FOREIGN PATENT DOCUMENTS

CA 102189350 9/2011
CA 102828085 12/2012

(Continued)

OTHER PUBLICATIONS

Lumsden, J.B. et al. "Intergranular corrosion following friction stir welding of aluminum alloy 7075-T651." 1999. Corrosion. 55. p. 1-7. (Year: 1999).*

(Continued)

*Primary Examiner* — Nicholas A Wang
(74) *Attorney, Agent, or Firm* — Walters & Wasylyna LLC

(57) ABSTRACT

A method for making an aluminum alloy includes steps of (1) weighing out starting materials to achieve a mass of material having a composition that includes aluminum, about 1.8 to about 5.6 percent by weight copper, about 0.6 to about 2.6 percent by weight lithium, and at least one of lanthanum up to about 1.5 percent by weight, strontium up to about 1.5 percent by weight, cerium up to about 1.5 percent by weight, and praseodymium up to about 1.5 percent by weight; (2) loading said starting materials into a crucible; (3) inserting said crucible into a chamber; (4) evacuating said chamber to a predetermined vacuum level; (5) melting said starting materials to form a molten mass; and (6) casting said molten mass into a mold.

20 Claims, 1 Drawing Sheet

(51) Int. Cl.

| | |
|---|---|
| ***B22D 7/00*** | (2006.01) |
| ***C22C 21/16*** | (2006.01) |
| ***C22C 21/14*** | (2006.01) |
| ***C22C 21/12*** | (2006.01) |

(56) References Cited

U.S. PATENT DOCUMENTS

| | | | | |
|---|---|---|---|---|
| 2004/0056075 | A1 | 3/2004 | Georghe | |
| 2007/0000583 | A1 | 1/2007 | Rioja et al. | |
| 2014/0212326 | A1 | 7/2014 | Colvin et al. | |
| 2016/0060741 | A1* | 3/2016 | Chevy | C22F 1/057 148/552 |

FOREIGN PATENT DOCUMENTS

| | | | |
|---|---|---|---|
| CN | 102021397 | * | 4/2011 |
| CN | 102634706 | | 8/2012 |
| CN | 104451272 | | 3/2015 |
| JP | 62-158851 | | 7/1987 |
| JP | 9-111429 | | 4/1997 |
| JP | 2002-53925 | | 2/2002 |
| JP | 2004-505176 | | 2/2004 |
| JP | 2008-223087 | | 9/2008 |
| KR | 1019920703864 | | 12/1992 |
| RU | 1 785 286 | | 8/1994 |
| RU | 2163940 | * | 8/1999 |
| WO | WO 02/10466 | | 2/2002 |
| WO | WO 2008/117706 | | 10/2008 |

OTHER PUBLICATIONS

"Friction Stir welding". Jay Deinken. Rockwell Science Center. 1999. (Year: 1999).*

Zheng, Z.Q. et al. "The microstructure and fracture toughness of an Al—Li—Cu—Mg—Zr alloy containing minor lanthanum additions." 1994. Science letters. 13. p. 946-949. (Year: 1994).*

Sidhu, M. et al. "Friction stir welding—process and its variables: a review." 2012. International journal of emerging technology and advanced engineering. 2. 12. p. 275-279. (Year: 2012).*

European Patent Office, "Summons to Attend Oral Proceedings Pursuant to Rule 115(1) EPC," App. No. 18165961.6 (Apr. 5, 2022).

The Aluminum Association: "International Alloy Designations and Chemical Composition Limits for Wrought Aluminum and Wrought Aluminum Alloys," (2018).

Japan Patent Office, Office Action, with English translation, App. No. 2018-0736327 (dated Mar. 8, 2022).

Canadian Intellectual Property Office, Office Action, App. No. 3,000,407 (dated May 26, 2021).

Akhtar et al: "Melting and casting of lithium containing aluminum alloys," *International Journal of Cast Metals Research*, pp. 1-8 (Feb. 2015).

Yuan G S et al: "Structure and mechanical properties of rapidly solidified Al@?Li@?Cu@?Mg alloys containing minor zirconium and rare earths", Materials Science and Engineering: A, Elsevier, Amsterdam, NL, vol. 134, (Mar. 25, 1991).

Zheng Z Q et al: "The Microstructure and Fracture Toughness of an Al—Li—Cu—Mg—Zr Allosy Containing Minor Lanthanum Additions", Journal Of Materials Science Letter, Chapman and Hall Ltd. London, GB, vol. 13, No. 13, (Jul. 1, 1994).

Xinxiang Yu et al: "Microstructure Evolution of Novel Al—Cu—Li—Ce Alloys during Homogenization", Rare Metal Materials and Engineering, vol. 45, No. 7, (Jul. 1, 2016).

Xinxiang Yu et al: "Effects of Cerium and Zirconium Microalloying Addition on the Microstructures and Tensile Properties of Novel Al—Cu—Li Alloys", Rare Metal Materials and Engineering, vol. 45, No. 8, (Aug. 1, 2016).

Xinxiang Yu et al: "Effects of Cerium Addition on Solidification Behaviour and Intermetallic Structure of Novel Al—Cu—Li Alloys", Rare Metal Materials and Engineering, vol. 45, No. 6, (Jun. 1, 2016).

Canadian Intellectual Property Office, Office Action, App. No. 3,000,407 (dated Nov. 19, 2021).

Lumsden et al: "Intergranular Corrosion Following Friction Stir Welding of Aluminum Alloy 7075-T651," *Corrosion*, pp. 1127-1135 (Dec. 1, 1999).

National Institute of Industrial Property (Brazil), Office Action, with English translation, App. No. BR102018007241-2 (dated Jul. 4, 2022).

The Korean Intellectual Property Office, Office Action, with English translation, App. No. 10-2018-0041370 (dated May 27, 2022).

China National Intellectual Property Administration, Office Action, with English translation, App. No. 201810313813.4 (dated Aug. 9, 2021).

China National Intellectual Property Administration, Office Action, with English translation, App. No. 201810313813.4 (dated Jan. 14, 2022).

Federal Service for Intellectual Property, Office Action, with English translation, App. No. 2018112213/05(019030) (dated Jul. 5, 2021).

Japan Patent Office, Office Action, with English translation, App. No. 2018-073627 (dated Oct. 18, 2022).

The Korean Intellectual Property Office, Office Action, with English translation, App. No. 10-2018-0041370 (dated Nov. 30, 2022).

Japan Patent Office, Office Action, with English Translation, App. No. 2018-073627 (dated May 2, 2023).

National Institute of Industrial Property (Brazil), Office Action, with English translation, App. No. BR102018007241-2 (dated Apr. 20, 2023).

Japan Patent Office, Office Action, with English translation, App. No. 2018-073627 (dated Oct. 17, 2023).

* cited by examiner

ALUMINUM ALLOY WITH ADDITIONS OF COPPER, LITHIUM AND AT LEAST ONE ALKALI OR RARE EARTH METAL, AND METHOD OF MANUFACTURING THE SAME

PRIORITY

This application is a divisional of U.S. Ser. No. 15/484,288 filed on Apr. 11, 2017.

FIELD

The present application relates to aluminum alloys and, more particularly, to aluminum alloys with additions of copper, lithium and at least one alkali or rare earth metal.

BACKGROUND

Friction stir welding (FSW) is a solid-state joining process that uses a non-consumable tool to join two facing workpieces without melting the workpiece material. Friction stir welding, while categorically a solid state joining process, typically generates enough heat input to coarsen and even dissolve the main strengthening phases in many aluminum alloys. The coarsening and dissolution of primary precipitates ultimately results in a measurable drop in strength across the weld, often epitomized by a classic W-shaped hardness profile.

Accordingly, those skilled in the art continue with research and development efforts in the field of aluminum alloys.

SUMMARY

In one embodiment, the disclosed aluminum alloy includes aluminum, about 1.8 to about 5.6 percent by weight copper, about 0.6 to about 2.6 percent by weight lithium, and at least one of lanthanum up to about 1.5 percent by weight, strontium up to about 1.5 percent by weight, cerium up to about 1.5 percent by weight, and praseodymium up to about 1.5 percent by weight.

In another embodiment, the disclosed aluminum alloy includes aluminum, about 1.8 to about 5.6 percent by weight copper, about 0.6 to about 2.6 percent by weight lithium, at least one of lanthanum, strontium, cerium and praseodymium in a non-zero quantity up to about 1.5 percent by weight, each, magnesium in a non-zero quantity up to about 1.9 percent by weight, zirconium in a non-zero quantity up to about 0.16 percent by weight, and silver in a non-zero quantity up to about 0.7 percent by weight.

In yet another embodiment, the disclosed aluminum alloy includes aluminum, about 1.8 to about 5.6 percent by weight copper, about 0.6 to about 2.6 percent by weight lithium, at least one of lanthanum, strontium, cerium and praseodymium in a non-zero quantity up to about 1.5 percent by weight, each, magnesium in a non-zero quantity up to about 1.9 percent by weight, zirconium in a non-zero quantity up to about 0.16 percent by weight, silver in a non-zero quantity up to about 0.7 percent by weight, manganese in a non-zero quantity up to about 0.6 percent by weight, zinc in a non-zero quantity up to about 1.0 percent by weight, and titanium in a non-zero quantity up to about 0.15 percent by weight.

In one embodiment, the disclosed method for manufacturing an aluminum alloy includes the steps of: (1) weighing out starting materials to achieve a mass of material that includes aluminum, about 1.8 to about 5.6 percent by weight copper, about 0.6 to about 2.6 percent by weight lithium, and at least one of lanthanum up to about 1.5 percent by weight, strontium up to about 1.5 percent by weight, cerium up to about 1.5 percent by weight and praseodymium up to about 1.5 percent by weight; (2) loading the materials into a crucible; (3) inserting the crucible into a chamber; (4) evacuating the chamber to a predetermined vacuum level; (5) melting the materials to form a molten mass; and (6) casting the molten mass into a mold.

Other embodiments of the disclosed aluminum alloy composition and method will become apparent from the following detailed description, accompanying drawings and the appended claims.

DETAILED DESCRIPTION

Figure 1:
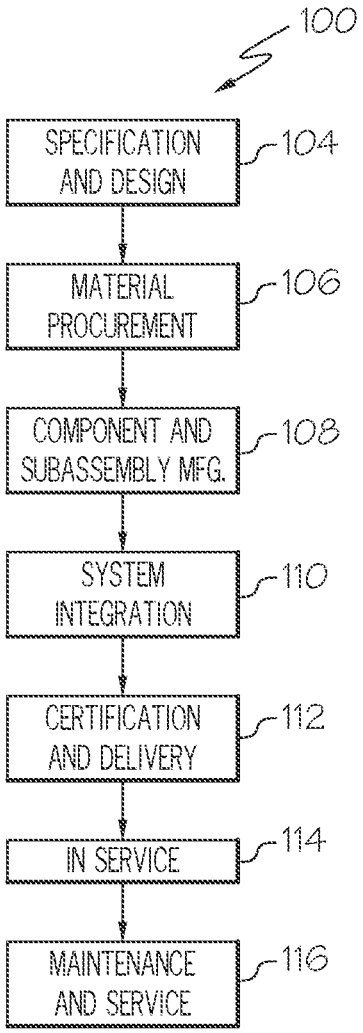
FIG. 1 is a flow diagram of an aircraft manufacturing and service methodology.

Disclosed are aluminum alloys that have been improved by the addition of lanthanum (La), cerium (Ce), strontium (Sr), praseodymium (Pr), other rare or alkali earth metals, other lanthanides, and rare earth metal in the form of mischmetal, along with various other elements traditionally used in aluminum alloys. For example, aluminum alloys from the 2xxx series Al—Cu—Li alloys registered by the Aluminum Association have been improved by the addition La, Ce, Sr, Pr, other rare or alkali earth metals, and rare-earth ore in the form of mischmetal. The disclosed aluminum alloys are designed to generate a dynamic response of the material to the friction stir welding (FSW) process. Without being limited to any particular theory, it is believed that the additional elements have three primary thermodynamic and physical criteria that improve the property of the disclosed aluminum alloy, set forth below.

The T1 phase (the primary strengthening phase in the Al—Cu—Li system) favors distorted lattice sites for nucleation. Thus, the high degree of strain misfit generated by these additional elements will spur nucleation of the T1 phase. In combination, the criteria described herein create an ideal scenario for nucleation and subsequent re-precipitation of the T1 phase during the FSW process. The resulting effect will be a marked improvement in strength and other inherent material properties in the weld zone. Finally, the additional elements would eliminate the measurable drop in strength typically observed across weld zones. This would result in a new class of aluminum alloys that could be implemented in more critical design spaces, and more amenable to a desirable and efficient fabrication process (e.g., FSW).

One general example of the disclosed aluminum alloy has the composition shown in Table 1.

TABLE 1

| Element | Quantity (wt. %) |
|---|---|
| Copper | 1.8-5.6 |
| Lithium | 0.6-2.6 |
| At least one of La, Sr, Ce and Pr | Non-zero-1.5 each |
| Other elements | Zero to 6.0 |
| Aluminum | Balance |

Thus, the aluminum alloy of Table 1 comprises about 1.8 to about 5.6 percent by weight copper, about 0.6 to about 2.6 percent by weight lithium, at least one of lanthanum, strontium, cerium, and praseodymium in a non-zero quantity up to about 1.5 percent by weight, wherein each of the at least one of the lanthanum, strontium, cerium, and praseodymium can be present at the non-zero quantity up to about 1.5 percent by weight, and the balance is substantially aluminum. The at least one of La, Sr, Ce, and Pr could be sourced from mischmetal. Mischmetal is a rare-earth metal ore mixture, typically predominately Ce and La with smaller amounts of Pr, Sr, and neodymium (Nd), but potentially containing other lanthanides. Accordingly, low levels of other lanthanides may also be present in the disclosed aluminum alloy.

The aluminum alloy of the first embodiment may further include silicon in a non-zero quantity up to about 0.20 percent by weight or about 0.05 to about 0.20 percent by weight. The aluminum alloy of the first embodiment may further include iron in a non-zero quantity up to about 0.30 percent by weight or from about 0.07 to about 0.30 percent by weight. The aluminum alloy of the first embodiment may further include manganese in a non-zero quantity up to about 0.6 percent by weight or about 0.03 to about 0.6 percent by weight. The aluminum alloy of the first embodiment may further include magnesium in a non-zero quantity up to about 1.9 percent by weight or about 0.05 to about 1.9 percent by weight. The aluminum alloy of the first embodiment may further include chromium in a non-zero quantity up to about 0.10 percent by weight. The aluminum alloy of the first embodiment may further include zinc in a non-zero quantity up to about 1.0 percent by weight or about 0.03 to about 1.0 percent by weight. The aluminum alloy of the first embodiment may further include titanium in a non-zero quantity up to about 0.15 percent by weight or about 0.07 to about 0.15 percent by weight. The aluminum alloy of the first embodiment may further include silver in a non-zero quantity up to about 0.7 percent by weight or about 0.05 to about 0.7 percent by weight. The aluminum alloy of the first embodiment may further include zirconium in a non-zero quantity up to about 0.16 percent by weight or about 0.04 to about 0.16 percent by weight. The aluminum alloy of the first embodiment may further include at least one of nickel, gallium, and vanadium in a non-zero quantity up to about 0.05 percent by weight each.

Those skilled in the art will appreciate that various impurities, which do not substantially affect the physical properties of the aluminum alloy of the first embodiment, may also be present, and the presence of such impurities will not result in a departure from the scope of the present disclosure.

Another general example of the disclosed aluminum alloy has the composition shown in Table 2.

TABLE 2

| Element | Quantity (wt. %) |
|---|---|
| Si | 0.05-0.20 |
| Cu | 1.8-5.6 |
| Fe | 0.07-0.30 |
| Mn | 0.03-0.6 |
| Mg | 0.05-1.9 |
| Cr | 0-0.10 |
| Ni | 0-0.05 |
| Zn | 0-1.0 |
| Ti | 0-0.15 |
| Ag | 0-0.7 |
| Li | 0.6-2.6 |
| Zr | 0-0.16 |
| La | 0-1.5 |

TABLE 2-continued

| Element | Quantity (wt. %) |
|---|---|
| Sr | 0-1.5 |
| Ce | 0-1.5 |
| Pr | 0-1.5 |
| Al | Substantially balance |

The aluminum alloy of Table 2 includes the elements listed and the balance is either aluminum or substantially aluminum along with various impurities. In the general example of Table 2, at least one of La, Sr, Ce, and Pr must be present in a non-zero quantity.

One specific, non-limiting example of the disclosed aluminum alloy has the composition shown in Table 3.

TABLE 3

| Element | Target (wt. %) |
|---|---|
| Copper | 4.0 |
| Lithium | 1.0 |
| Magnesium | 0.4 |
| Zirconium | 0.13 |
| Silver | 0.35 |
| Strontium | 0.5 |
| Aluminum | 93.62 |

Another specific, non-limiting example of the disclosed aluminum alloy has the composition shown in Table 4.

TABLE 4

| Element | Target (wt. %) |
|---|---|
| Cu | 4.07 |
| Fe | 0.07 |
| Mn | 0.04 |
| Mg | 0.37 |
| Zn | 0.04 |
| Ti | 0.08 |
| Zr | 0.13 |
| Ag | 0.24 |
| Li | 0.94 |
| Sr | 0.30 |
| La | <0.01 |
| Al | Balance |

Yet another specific, non-limiting example of the disclosed aluminum alloy has the composition shown in Table 5.

TABLE 5

| Element | Target (wt. %) |
|---|---|
| Cu | 4.0 |
| Fe | 0.07 |
| Mn | 0.04 |
| Mg | 0.36 |
| Zn | 0.04 |
| Ti | 0.08 |
| Zr | 0.13 |
| Ag | 0.23 |
| Li | 0.93 |
| La | 0.13 |
| Sr | <0.01 |
| Al | Balance |

The disclosed aluminum alloy can be made by a variety of techniques. One method for manufacturing the disclosed aluminum alloy includes the steps of: (1) weighing out starting materials to achieve a mass of material within the composition of an aluminum alloy comprising about 1.8 to about 5.6 percent by weight copper, about 0.6 to about 2.6 percent by weight lithium, at least one of lanthanum, strontium, cerium, and praseodymium in a non-zero quantity up to about 1.5 percent by weight, each, and aluminum; (2) loading the materials into a crucible; (3) inserting the crucible into a chamber; (4) evacuating the chamber to a predetermined vacuum level wherein said chamber is optionally backfilled with an inert gas; (5) melting the materials to form a molten mass; and (6) casting the molten mass into a mold. Once the molten mass is cast into a mold, the molten mass is cooled to form a solid mass, the solid mass is homogenized and water quenched to yield an ingot, the ingot is scalped and hot rolled, and the ingot is solution treated and water quenched, cold-rolled or stretched, and artificially or otherwise naturally aged to yield the aluminum alloy.

The weighing out of starting materials step may include the use of mischmetal as the source of at least one of lanthanum, strontium, cerium, and praseodymium in a non-zero quantity up to about 1.5 percent by weight, each. Mischmetal is a rare-earth metal ore mixture, typically predominately Ce and La with smaller amounts of Pr, Sr, and Nd, but potentially containing other lanthanides. Mischmetals are cost-effective rare-earth elements one could use in the present invention to decrease the cost. The rare-earth elements are relatively expensive because a larger contributor to the cost of the rare-earth elements is the step of isolating rare earth elements. By utilizing mischmetals, the isolation step is avoided, thus the final product will be less expensive yet similarly effective.

In one specific, non-limiting example of the disclosed method, charge materials are weighed out and loaded in a graphite crucible. The chamber is then evacuated to a vacuum level below about 0.05 Torr and backfilled with an inert gas (e.g., argon) to a partial pressure of about 760 Torr. The charge is melted and cast into a graphite mold and allowed to air cool. The as-cast ingot can then be homogenized at about 840° F. for about 24 hours and water quenched. The ingot can then be scalped and hot rolled at about 900° F. to thickness. It will then be solution treated at 950° F. for about 1 hour and water quenched. Finally, it will be cold-rolled with about a 5% reduction and artificially aged. It can be artificially aged at about 310° F. for about 32 hour, yielding an aluminum alloy of the present invention.

Figure 2:
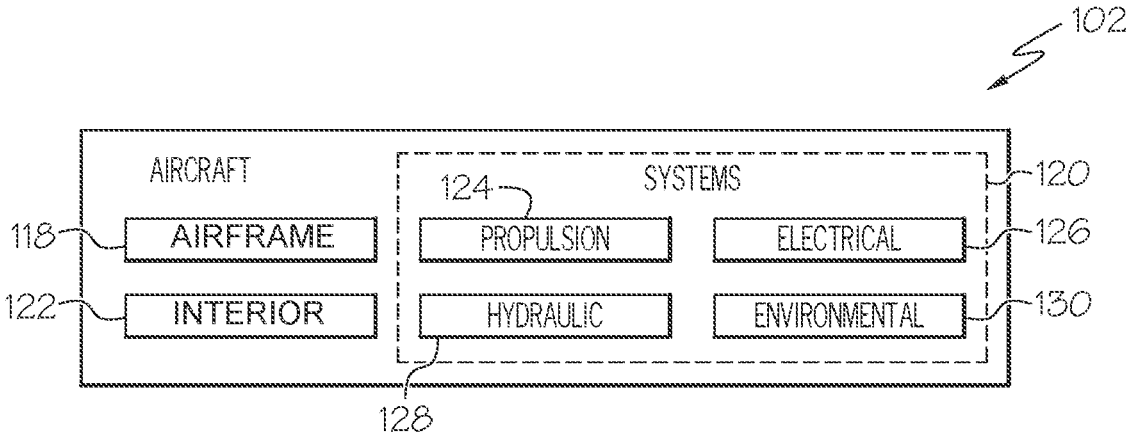
FIG. 2 is a block diagram of an aircraft.

Examples of the disclosure may be described in the context of an aircraft manufacturing and service method 100, as shown in FIG. 1, and an aircraft 102, as shown in FIG. 2. During pre-production, the aircraft manufacturing and service method 100 includes, for example, specification and design 104 of the aircraft 102 and material procurement 106. During production, component/subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator includes, without limitation, any number of aircraft manufacturers and major-system subcontractors; a third party includes, without limitation, any number of venders, subcontractors, and suppliers; and an operator may be an airline, leasing company, military entity, service organization, and so on.

As shown in FIG. 2, the aircraft 102 produced by example method 100 includes, for example, an airframe 118 with a plurality of systems 120 and an interior 122. Examples of the plurality of systems 120 include one or more of a propulsion system 124, an electrical system 126, a hydraulic system 128, and an environmental system 130. Any number of other systems may be included.

The disclosed aluminum alloy composition and article formed therefrom may be employed during any one or more of the stages of the aircraft manufacturing and service method 100. As one example, components or subassemblies corresponding to component/subassembly manufacturing 108, system integration 110, and or maintenance and service 116 may be fabricated or manufactured using the disclosed aluminum alloy composition. As another example, the airframe 118 may be constructed using the disclosed aluminum alloy composition. Also, one or more apparatus examples, method examples, or a combination thereof may be utilized during component/subassembly manufacturing 108 and/or system integration 110, for example, by substantially expediting assembly of or reducing the cost of an aircraft 102, such as the airframe 118 and/or the interior 122. Similarly, one or more of system examples, method examples, or a combination thereof may be utilized while the aircraft 102 is in service, for example and without limitation, to maintenance and service 116.

The disclosed aluminum alloy composition and article formed therefrom is described in the context of an aircraft; however, one of ordinary skill in the art will readily recognize that the disclosed aluminum alloy composition and article formed therefrom may be utilized for a variety of applications. For example, the disclosed aluminum alloy composition and article formed therefrom may be implemented in various types of vehicles including, for example, helicopters, passenger ships, automobiles, marine products (boat, motors, etc.) and the like.

Although various embodiments of the disclosed aluminum alloy composition and article formed therefrom have been shown and described, modifications may occur to those skilled in the art upon reading the specification. The present application includes such modifications and is limited only by the scope of the claims.

What is claimed is:

1. A method for manufacturing an aluminum alloy comprising:

subjecting an aluminum alloy to a solid-state joining process, wherein the aluminum alloy comprises:
- aluminum;
- about 1.8 to about 5.6 percent by weight copper;
- about 0.6 to about 2.6 percent by weight lithium; and
- at least one of lanthanum, cerium, and praseodymium in a range of between 0.5 to about 1.5 percent by weight, wherein T1 phase is precipitated during the solid-state joining process; and aging the aluminum alloy before the solid-state joining process.

2. The method of claim 1 wherein the solid-state joining process comprises friction stir welding.

3. The method of claim 1 wherein aging the aluminum alloy before the solid-state joining process comprises artificially aging at about 300 to about 320° F. for about 29 to about 35 hours.

4. The method of claim 1 wherein the aluminum alloy further comprises titanium in a non-zero quantity up to about 0.15 percent by weight.

5. The method of claim 1 wherein the aluminum alloy further comprises silver in a non-zero quantity up to about 0.7 percent by weight.

6. The method of claim 1 wherein the aluminum alloy further comprises silicon in a non-zero quantity up to about 0.20 percent by weight.

7. The method of claim 1 wherein the aluminum alloy further comprises iron in a non-zero quantity up to about 0.30 percent by weight.

8. The method of claim 1 wherein the aluminum alloy further comprises manganese in a non-zero quantity up to about 0.6 percent by weight.

9. The method of claim 1 wherein the aluminum alloy further comprises chromium in a non-zero quantity up to about 0.10 percent by weight.

10. The method of claim 1 wherein the aluminum alloy further comprises zirconium in a non-zero quantity up to about 0.16 percent by weight.

11. The method of claim 1 wherein the aluminum alloy further comprises at least one of nickel up to about 0.05 percent by weight, gallium up to about 0.05 percent by weight and vanadium up to about 0.05 percent by weight.

12. The method of claim 1 wherein the aluminum alloy further comprises magnesium in a non-zero quantity up to about 1.9 percent by weight.

13. The method of claim 1 wherein the aluminum alloy further comprises magnesium in a range of about 0.05 to about 1.9 percent by weight.

14. The method of claim 1 wherein the aluminum alloy further comprises zinc in a non-zero quantity up to about 1.0 percent by weight.

15. The method of claim 1 wherein the aluminum alloy further comprises zinc in a range of about 0.03 to about 1.0 percent by weight.

16. The method of claim 1 wherein at least one of lanthanum and praseodymium is in a range of between 0.5 to about 1.5 percent by weight.

17. The method of claim 16 wherein the aluminum alloy further comprises magnesium in a non-zero quantity up to about 1.9 percent by weight.

18. The method of claim 16 wherein the aluminum alloy further comprises magnesium in a range of about 0.05 to about 1.9 percent by weight.

19. The method of claim 16 wherein the aluminum alloy further comprises zinc in a non-zero quantity up to about 1.0 percent by weight.

20. The method of claim 16 wherein the aluminum alloy further comprises zinc in a range of about 0.03 to about 1.0 percent by weight.

* * * * *